United States Patent [19]

Robin et al.

[11] Patent Number: 4,509,053

[45] Date of Patent: Apr. 2, 1985

[54] BLADE ANTENNA WITH SHAPED DIELECTRIC

[75] Inventors: Seymour Robin, Woodland Hills; Yosef Klein, Northridge, both of Calif.

[73] Assignee: Sensor Systems, Inc., Chatsworth, Calif.

[21] Appl. No.: 401,867

[22] Filed: Jul. 26, 1982

[51] Int. Cl.[3] ..... H01Q 1/28; H01Q 13/10

[52] U.S. Cl. ..... 343/708; 343/767; 343/770

[58] Field of Search ..... 343/708, 705, 746, 767, 343/768, 769, 770, 789, 829, 846, 893

[56] References Cited

U.S. PATENT DOCUMENTS

| | | | |
|---|---|---|---|
| 2,507,528 | 5/1950 | Kandoian | 343/767 |
| 2,614,219 | 10/1952 | Cary | 343/708 |
| 2,949,606 | 8/1960 | Dorne | 343/708 |
| 3,193,829 | 7/1965 | Braun et al. | 343/708 |
| 3,220,006 | 3/1965 | Young et al. | 343/708 |
| 3,500,421 | 3/1970 | Caron | 343/708 |
| 4,072,952 | 2/1978 | Demko | 343/708 |
| 4,371,877 | 2/1983 | Doussot et al. | 343/770 |

FOREIGN PATENT DOCUMENTS 2212647 9/1973 Fed. Rep. of Germany ..... 343/767

OTHER PUBLICATIONS

Sensor Systems Inc., Chatsworth, Cal., Blueprint Drawing Entitled "Machine Casting S65-8280-Series VHF Antenna", 1975.

*Primary Examiner*—Eli Lieberman
*Assistant Examiner*—Michael C. Wimer
*Attorney, Agent, or Firm*—Koppel & Harris

[57] ABSTRACT

A Tee slot blade antenna for aircraft and other high speed vehicles has a pair of dielectric sections, one section extending longitudinally along the blade and the other extending transversely from an intermediate location along the longitudinal section. The resonant frequency of the antenna is determined by the length of each section and the position of the transverse section along the longitudinal one, while the characteristic impedance is a function of the width of each section. The Tee slot antenna is capable of operating over a wide bandwidth on a smaller blade than prior single slot antennas. A Tee slot antenna designed for one frequency range can be combined with either a single slot antenna or another Tee slot antenna designed for another frequency range on the same antenna blade, without impairing the bandwidth of either antenna.

17 Claims, 7 Drawing Figures

BLADE ANTENNA WITH SHAPED DIELECTRIC

BACKGROUND OF THE INVENTION

1. Field of the Invention

This invention relates to antennas, and more particularly to antennas suitable for use on aircraft.

2. Description of the Prior Art

Antennas designed for use with aircraft radios and guidance equipment are commonly available in the form of a streamlined blade-like member which is attached to the outer surface of the aircraft. A useful antenna of this type is described in U.S. Pat. No. 3,220,006 to David W. Young and Harvey P. Bazar, Ground Plane VHF Antenna Comprising Blade-Type Dipole Configuration Obtained By Reflecting Monopole In Ground Plane. In this device an elongated slot passes entirely through the width of a metallic blade member, extending diagonally from the area of the leading edge and base of the blade upwardly toward the trailing edge. The slot contains a dielectric material, the exterior surface of which is flush with the exterior surface of the blade member. A two-conductor transmission line feeds a signal to be radiated to the dielectric material, while the base of the blade is mounted on a conductive ground plane which provides a ground reference for the antenna. This type of construction was found to have improved mechanical strength, corrosion resistance, radiating efficiency, aerodynamic characteristics and lightning protection over previously available aircraft antennas.

While the blade antenna described above operates satisfactorily, it is always desirable to reduce the size of the antenna as much as possible so as to reduce air drag and weight, both of which are highly important factors for high-speed aircraft. The above-described prior art antenna blade must of necessity be longer than the length of the radiating dielectric material which it carries, while the dielectric material in turn is disposed in a strip the length of which is governed by the desired frequency of operation. No reduction in the length of this type of antenna, with a corresponding reduction in weight and air drag is possible without increasing its resonant frequency.

Most aircraft have a requirement for broadcasting within three different frequency ranges: one frequency for oral communication with the airport tower, a second frequency for glide slope signals, and a third frequency for radar broadcasts required by the transponder and DME (Distance Measuring Equipment). In order to reduce the number of separate blade antennas required, attempts have been made in the past to place two strips of dielectric material on the same blade, with the dimensions of each strip selected so that they respond to excitation in different frequency ranges. While it has been possible to achieve broadcasts in two different frequency ranges in this manner, it has been found that if one of the antennas is capable of transmitting over a relatively broad frequency range, the other strip is restrained to a relatively narrow band of frequencies, typically about 10 MHz. A practical system capable of broadcasting from a blade antenna over two separate wide band frequency ranges has not been available.

SUMMARY OF THE INVENTION

In view of the above problems associated with the prior art, it is an object of the present invention to provide a novel and improved blade antenna which is capable of broadcasting over a given frequency range from a smaller size and lighter weight blade than was previously possible.

Another object is the provision of a novel and improved blade antenna which is capable of radiating signals over a broad frequency bandwidth and at high efficiency.

Still another object of the invention is the provision of a novel and improved blade antenna which is capable of transmitting signals within two separate frequency ranges, both of which are broad band.

In the accomplishment of these and other objects of the invention, an antenna is provided on a metallic blade-like member having a base portion, a leading edge and a trailing edge. A dielectric material is held within slots formed in the blade-like member, with a first section of a dielectric material extending in a longitudinal direction and a second section extending from an intermediate location along the first section in a direction which is generally transverse to the first section, producing a "Tee slot" configuration. Means are provided for feeding a radiating signal to the dielectric material.

The transverse section extends from the longitudinal section at an angle of at least about 60°, and preferably about 90°. The length of each section and the location of the transverse section along the longitudinal section are selected to produce a desired resonant frequency, while the widths of the various dielectric sections are selected to produce a desired characteristic impedance. In order to achieve transmissions in a second frequency range, a second dielectric filled radiating slot is carried by the antenna, spaced away from the first slot. The second slot may be in the form of a generally longitudinal strip of dielectric material terminating at the leading or trailing edge of the blade, or another Tee slot antenna.

Further objects and features of the invention will be apparent to those skilled in the art from the following detailed description of preferred embodiments thereof, taken together with the accompanying drawings, in which:

DETAILED DESCRIPTION OF PREFERRED EMBODIMENTS

Figure 1:
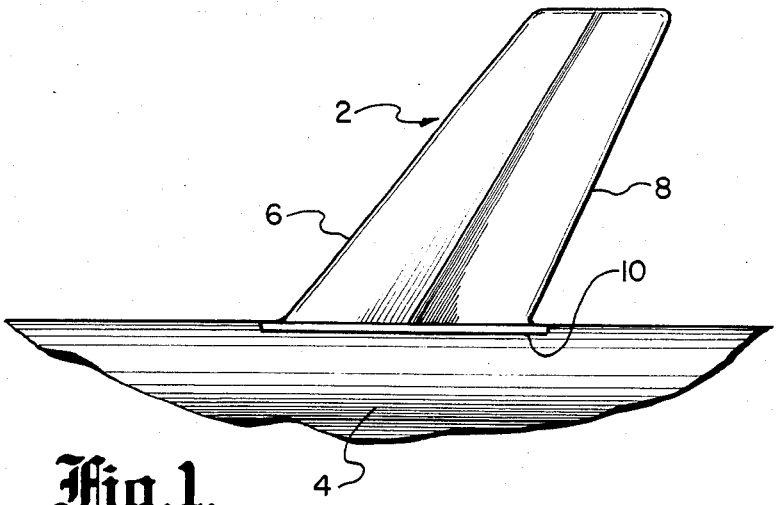
FIG. 1 is a side elevation view illustrating the manner in which the antenna of the present invention is installed on an airframe.

The blade antenna 2 of the present invention is shown mounted on the skin 4 of an aircraft, missile or the like in FIG. 1. The antenna has a leading edge 6, a trailing edge 8 and a base portion 10. The skin 4 of the aircraft is provided with a receiving opening to accommodate the base portion 10 of the antenna, permitting a flush installation in which the surface of the antenna base is faired into the surface of the aircraft skin 4. The antenna may be painted to have a uniformly solid appearance as shown in FIG. 1.

Figure 2:
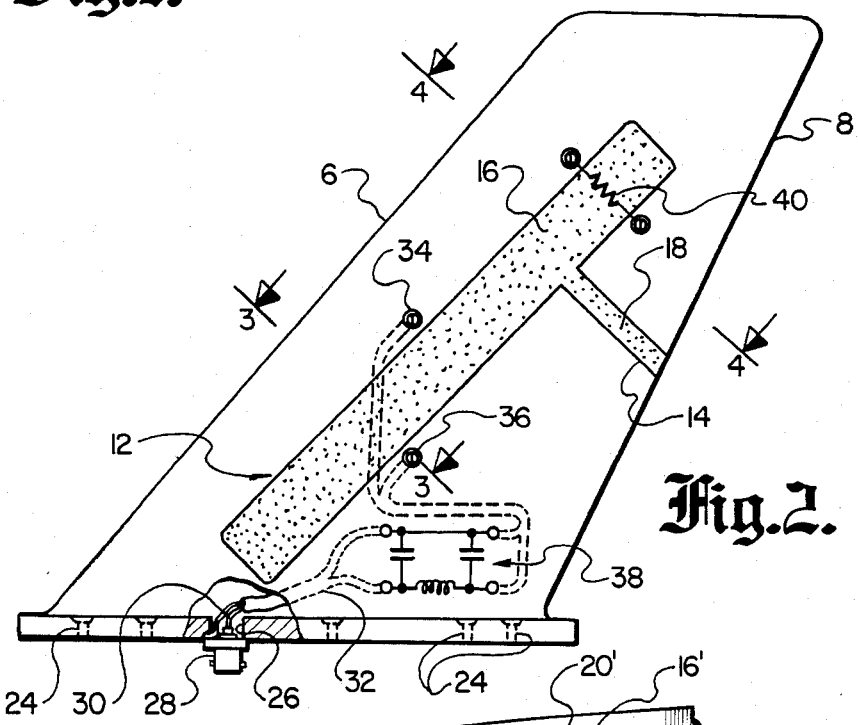
FIG. 2 is a side elevation view of an antenna constructed in accordance with the invention.

Details of the antenna construction are shown in FIG. 2. The main body of the antenna 2 comprises a blade-like member which may be cast from aluminum, magnesium, or a similar metal. The interior of the casting is hollow, with a slot 12 extending generally from the vicinity of base portion 10 near the lower portion of leading edge 6 towards the upper portion of the blade near trailing edge 8. This slot may be filled with a solid dielectric, preferably fiberglass, or in the simplest case the dielectric may be air. The use of a solid dielectric in slot 12 increases the structural rigidity and mechanical strength of the antenna.

A second, narrower slot 14 extends transversely from an intermediate location between the ends of longitudinal slot 12 towards the trailing edge 8 of the blade member. This arrangement of slots, with longitudinal slot 12 crossing over the top of transverse slot 14, is referred to herein as a "Tee slot" configuration, and forms an important part of the invention. Slot 14 is filled with the same dielectric material as slot 12, and in effect functions as an extension of slot 12 so that the antenna can operate at a lower frequency than is possible with slot 12 alone, without increasing the size of the blade. While transverse slot 14 is shown as extending at a right angle from longitudinal slot 12, satisfactory operation can also be achieved with the transverse slot at a lesser angle to the longitudinal slot. A significant amount of cross-coupling between the slots is introduced if they are positioned at an angle of less than about 60°, while the operating characteristics of the antenna are optimized if the angle between the slots is about 90°. Accordingly, while the antenna will still operate with an angle of less than 60° between the slots, it is preferred that the angle be greater than about 60°, and particularly about 90°.

Figure 3:
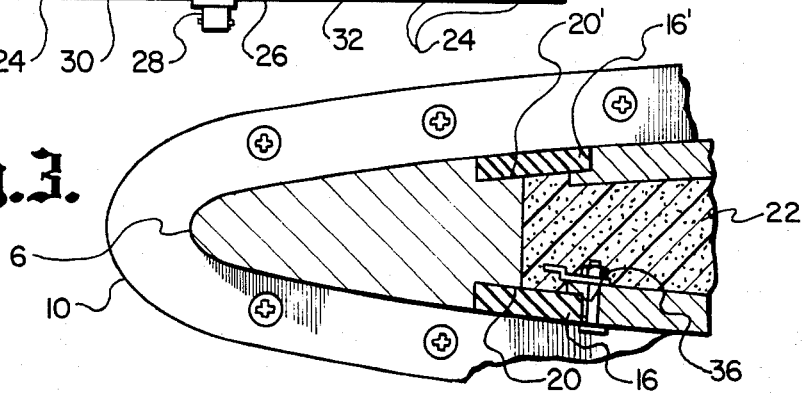
FIG. 3 is a fragmentary transverse sectional view taken along line 3—3 of FIG. 2.
Figure 4:
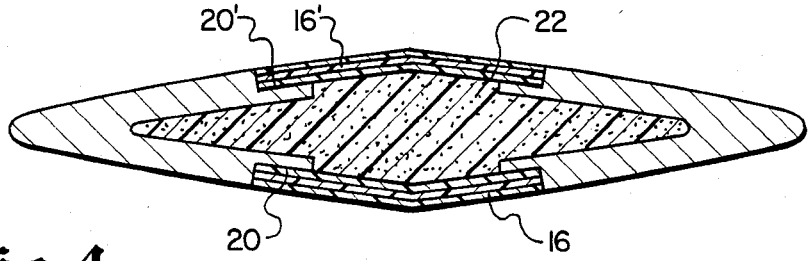
FIG. 4 is a sectional view taken along line 4—4 of FIG. 2.

The manner in which the dielectric material is held within the slots is similar to that described in U.S. Pat. No. 3,220,006. To facilitate the installation of a dielectric in the form of laminated fiberglass sheets 16 and 18 in slots 12 and 14, respectively, the slots may be provided with recessed edges or steps 20 to serve as support and attachment surfaces for the sheets. This type of arrangement is shown in FIGS. 3 and 4. Since the interior of the blade is hollow, two dielectric sheets 16 and 16' as well as two steps 20 and 20' are required. Sheets 16 and 16' may be adhesively bonded to steps 20 and 20', or attached thereto by any other suitable fastening means.

The other surfaces of sheets 16 and 16' are flush with the exterior surface of the main body of the blade, as shown in FIGS. 3 and 4. The hollow interior of the blade may be filled with a cellular plastic dielectric 22 or rigid plastic foam, or dielectric sheets 16 and 16' may be formed in an integral structure which extends all of the way between opposite surfaces of the blade. Alternately, if desired, the interior of the blade may be left hollow so that heated air may be forced therethrough in order to heat the surface of the antenna and thereby prevent ice from forming on the exterior surface during freezing weather.

To provide desirable aerodynamic characteristics compatible with high speed aircraft, the blade body 2 is streamlined and tilted to provide a sweep-back of 35° to 45° to its mounting base 10. This also results in a radiation pattern that is free from dip nulls through a 360° azimuth sector, and which accordingly permits a uniform coverage equivalent to an antenna axis that is parallel to the base 10. Referring back to FIG. 2, the base 10 of the antenna body is provided with a flared portion having the form of an external pressurized flange mounting. Base 10 contains a plurality of openings which are adapted to receive fastening screws 24 or other means for attaching the antenna to the airframe. In a typical installation, screws 24 are threadedly attached to a support member on the air frame which is tapped holes therein for receiving the screws.

The base 10 of the blade is provided with an aperture 26 into the bottom of which a connector 28 is lodged for interconnection with a coaxial cable (not shown) leading to the related radio equipment. Similar apertures are provided in the aircraft skin and the blade support member to accommodate connector 17. Electrical connection between the antenna and a transmission line (not shown) is made via cable connector 28, which may be of any well-known type suitable for interconnection with coaxial cable or the like. In a typical application, the transmission line may comprise a 52 ohm coaxial line. The center conductor 30 of cable 32 is attached to the shielded conductor of connector 28, and its opposite end terminates at a point on the edge of slot 12 nearest the leading edge 6 of the antenna blade and at a distance slightly more than one-half of the way up from the lower edge of slot 12. An electrical connection is made with the edge of the slot, and thereby with the dielectric material through the metallic blade, via screw connector 34.

The shield conductor of cable 32 is connected to the shell of connector 28, which in turn is grounded to the antenna base portion 10. The opposite end of the shield conductor of cable 32 is connected via screw connector 36 to the opposite edge of slot 12 from the center conductor 30, and vertically below connector 34.

As is well known, the antenna impedance should match the impedance of the transmission line which terminates at connector 28. However, this is very seldom the case, especially over a range of frequencies, so that it may become necessary to transform the antenna impedance by the use of a reactive network for maximum power transfer. In order to provide a better impedance match between the antenna and the transmission line and to reduce the voltage standing wave ratio (VSWR), various matching means well known to those skilled in the art may be employed. As indicated in FIG. 2, cable 32 is connected to an LC network 38 within the hollow core of blade body 2 to accomplish the desired impedance matching. Alternatively, an impedance matching stub wire such as that shown in U.S. Pat. No. 3,220,006 or other impedance matching means may be employed.

The widths of slots 12 and 14 and the dielectric sheets contained therein also have a significant effect on the antenna impedance. In this regard the width of transverse slot 14 has been found to have a more pronounced effect on the characteristic impedance of the antenna than the width of longitudinal slot 12. In this embodiment shown in FIG. 2 the width of slot 12 is one inch, while the width of slot 14 is one-half inch. These dimensions have been found to produce a favorable characteristic impedance for transmissions over a 116–156 MHz bandwidth, although other dimensions may be desirable for particular applications. In addition, a resistor 40 may be connected between the opposite edges of the upper portion of slot 12 in order to enhance impedance matching over a wide band width. In the embodiment shown in FIG. 2 the resistor is preferably 188 ohms.

The resonant frequency of the antenna is determined by the lengths and relative positions of the longitudinal and transverse dielectric sections. In the embodiment shown in FIG. 2, longitudinal slot 12 is 12 inches long, while transverse slot 14 is 3 inches long and extends from a location about two-thirds of the way up longitudinal slot 12. With this arrangment the antenna is capable of transmitting over a bandwidth of 116–156 MHz, centered on a resonant frequency for 136 MHz, wit VSWR of 2:1. The required antenna blade is only about 12 inches tall, as opposed to prior art antennas as disclosed in U.S. Pat. No. 3,220,006 in which a blade of approximately 17 inches is required to achieve the same frequency characteristics.

The resonant frequency may be altered by changing the length of either the longitudinal or the transverse slots, or by shifting the transverse slot up or down along the longitudinal slot.

The position of the cable feed points has also been found to have a significant effect on the frequency bandwidth which can be achieved. The optimum location of the feed points can be approximated by attempting to calculate the antenna's capacitive loading, as determined by the thickness of the blade metal, the nature of the dielectric material, the shapes of the various elements in the antenna, etc. However, it has been found more practical to obtain the optimum feed point location empirically.

Figure 5:
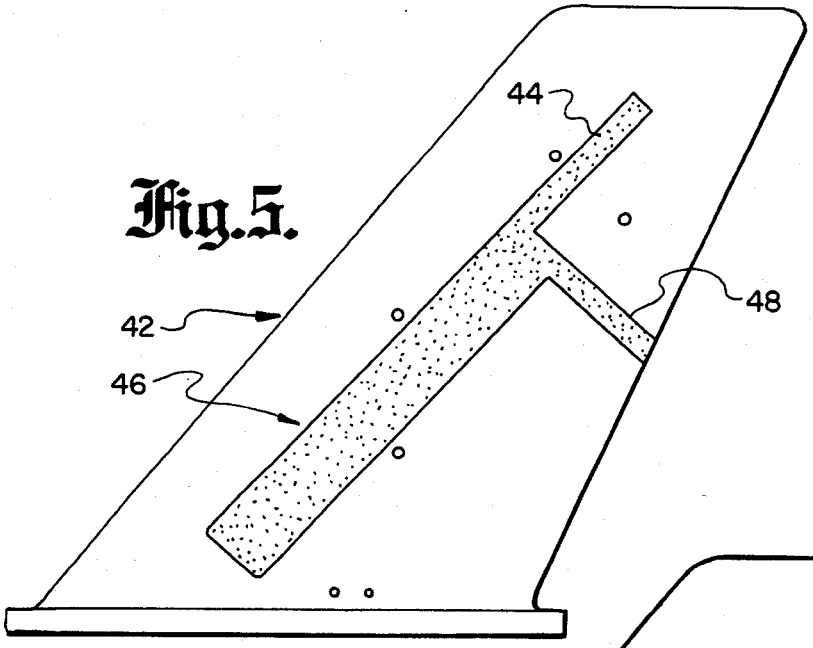
FIG. 5 is a side elevation view of another embodiment of the invention.

As noted above, the characteristic impedance of the antenna is affected by the widths of the dielectric sections. FIG. 5 illustrates a blade antenna 42 in which the upper portion 44 of a dielectric-filled longitudinal slot 46 above its intersection with a transverse slot 48 has a lesser width than the lower portion of the slot. The effect of the reduction in slot width is to lower the characteristic impedance of the antenna.

Figure 6:
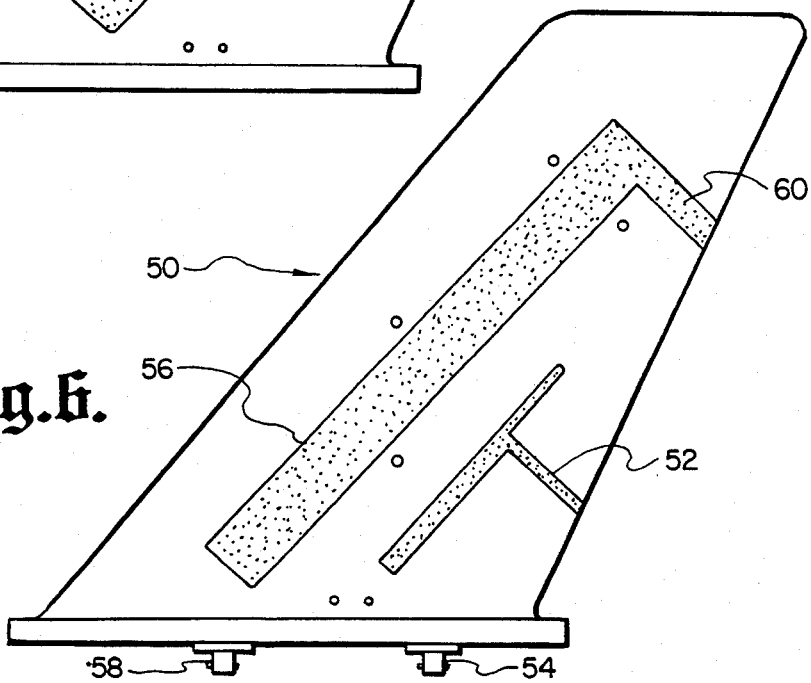
FIG. 6 is a side elevation view of a third embodiment of the invention which is capable of transmitting within two different frequency ranges.

Another embodiment of the invention comprising a dual frequency antenna is shown in FIG. 6. In this embodiment a blade antenna 50 is capable of radiating over two different frequency ranges. This combination of two antennas on one blade is important, since most aircraft require at least three different frequency ranges. A first frequency range is used for oral radio communications. This function is performed at 116–156 MHz for commercial and general aviation aircraft, 30–90 MHz for VHF-FM private and government aircraft, 156–180 MHz for police, fire and other special uses, and 225–600 MHz for military and inflight telephone. A second frequency range, generally 329–335 MHz, is used for the broadcast of glide slope instrument landing system information, while the "L-band" of 960–1220 MHz is employed for radar, typically the aircraft transponder and DME.

Dual frequency antenna 50 includes a Tee slot antenna 52 similar to the antenna shown in FIG. 2, and is supplied with a signal to be radiated by a cable (not shown) from connector 54. A conventional single slot antenna 56 is also provided on the forward portion of the blade from Tee slot antenna 56, and is supplied with a radiating signal in a different frequency range by a cable (not shown) from connector 58. Single slot antenna 56 is filled with a dielectric in a manner similar to that of the Tee slot antenna. It is necessary that the antenna intersect the edge of the blade, and for this purpose an extension 60 at its upper end extends the single slot antenna to the rear edge of the blade, resulting in an "L slot" type of antenna. L slot antennas are known in the art, but the upper exensions are for purposes of intersecting the blade edge, rather than for establishing the antenna's resonant frequency as in the novel Tee slot antenna of this invention, and the upper extensions are generally shorter than extension 60 in FIG. 6.

While prior art blade antennas are known in which two separate dielectric strips are employed to radiate within different frequency ranges, no way has previously been found to obtain a broad bandwidth for both frequency ranges. For example, if the dimensions of the first dielectric strip were selected such that it operated over a fairly wide frequency range of 116–156 MHz with a center frequency of 136 MHz, a second and smaller dielectric strip designed to operate at a higher frequency range on the same blade has not been capable of operating beyond a bandwidth of about 10 MHz.

If one of the antennas is provided in the form of a Tee slot antenna in accordance with the present invention, however, it has been found that an additional single slot antenna can be provided on the same blade, with both antennas capable of operating over relatively broad bandwidths. For example, if Tee slot antenna 52 radiates over a 225–400 MHz band, single slot antenna 56 can be made to operate effectively over a 116–156 MHz band. The two antennas 52 and 56 should be separated on the blade as much as possible so as to avoid cross-coupling effects.

Figure 7:
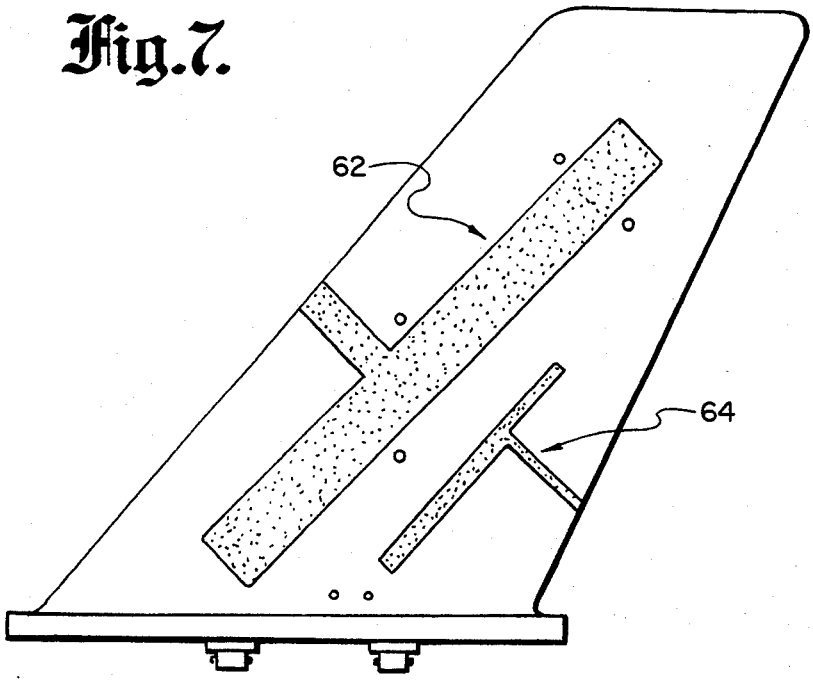
FIG. 7 is a side elevation view of a fourth embodiment of the invention which is capable of transmitting within two different frequency ranges.

FIG. 7 shows another embodiment of the invention in which two Tee slot antennas 62 and 64, with their transverse slots respectively terminating at the front and rear edges of the blade, are provided. The relative dimensions of the antennas are selected so that they each radiate over separate frequency ranges, for example a 116–156 MHz VHF band for antenna 62 and a 225–400 MHz UHF band for antenna 64. In addition to achieving a broad bandwidth in each range, the provisions of two Tee slot antennas on the same blade also results in a greater natural isolation between the two frequencies than was achieved with prior single slot antennas.

While particular embodiments of the invention have been described above, numerous variations and modifications will occur to those skilled in the art. For example, while the opposed edges of the various antenna slots have been shown as being parallel to each other, it would be possible to vary the shapes of the slots while still obtaining the benefits of the invention. The orientation of the antenna on the blade could also be altered. Furthermore, while a Tee slot antenna has been shown combined with another antenna on a single blade, it may be possible to provide more than two antennas on one blade. Accordingly, it is intended that the invention be limited only in terms of the appended claims.

We claim:

1. An antenna having a predetermined resonant frequency for high speed craft, comprising:

a blade-like member having a base portion, a leading edge and a trailing edge, a dielectric material disposed within the blade-like member in a radiating slot, a first section of said dielectric material extending generally longitudinally along the member, and a second section of said material extending generally transversely to the first section from an intermediate location thereon which is spaced inwardly from the ends of the first section, the location of the second section relative to the first section being selected to establish said predetermined resonant frequency, and means for feeding a radiating signal to said dielectric material.

2. The antenna of claim 1, wherein the widths of the longitudinal and transverse sections of dielectric material are selected to produce a desired characteristic impedance for the antenna.

3. The antenna of claims 1 or 2, wherein the respective lateral edges of said longitudinal and transverse sections of dielectric material are generally parallel.

4. The antenna of claim 1, wherein said transverse section of dielectric material extends at an angle of at least about 60° from the longitudinal section.

5. The antenna of claim 4, wherein said transverse section of dielectric material extends at an angle of about 90° from the longitudinal section.

6. The antenna of claims 1 or 2, wherein the width of the longitudinal section of dielectric material on the side of the transverse section opposite to the base portion is different from the width of the longitudinal section on the side of the transverse section closer to the base portion.

7. The antenna of claim 1, said blade being metallic.

8. The antenna of claims 1, 2 or 7, wherein said first and second sections of dielectric material are adapted to radiate signals within a first predetermined frequency band, further comprising a second dielectric filled radiating slot on said blade-like member, said second slot being spaced from the first radiating slot with its dielectric material adapted to radiate signals within a second predetermined frequency band, and means for feeding a radiating signal within said second band to the dielectric material within said second slot.

9. The antenna of claim 8, said second radiating slot comprising a generally longitudinal strip of dielectric material extending to an edge of said blade-like member.

10. The antenna of claim 8, said second radiating slot comprising a first section of dielectric material extending generally longitudinally along the member, and a second section of dielectric material extending generally transversely to the first section from an intermediate location thereon which is spaced inwardly from the ends of the first section.

11. An antenna having a predetermined resonant frequency for high speed craft, comprising:

a blade-like metallic member extending from a base portion and having a leading edge, a trailing edge, and a pattern of slots formed in the member, one of said slots extending longitudinally along the member generally from the vicinity of the base portion, and a second slot extending generally transversely from an intermediate location along the longitudinal slot which is spaced inwardly from the ends of the longitudinal slot, the location of the second slot relative to the longitudinal slot being selected to establish said predetermined resonant frequency, a dielectric material held within and generally conforming to the shapes of said slots, and means for feeding a first radiating signal to said dielectric material, the dimensions and relative positions of said slots being selected to produce signal radiation over a first predetermined frequency band.

12. The antenna of claim 11, said transverse slot extending at an angle of at least about 60° from the longitudinal slot.

13. The antenna of claim 12, said transverse slot extending at an angle of about 90° from the longitudinal slot.

14. The antenna of claim 11, wherein the width of the transverse slot is less than the width of the longitudinal slot.

15. The antenna of claims 11 or 14, wherein the width of the longitudinal slot on the side of the transverse slot opposite to the base portion is less than the width of the longitudinal slot on the side of the transverse slot closer to the base portion.

16. The antenna of claim 11, further comprising a resistor connected in circuit across the longitudinal slot on the side of the transverse slot opposite to the base portion to enhance impedance matching of the antenna over a wide bandwidth.

17. The antenna of claims 11, 12, 13 or 14, further comprising at least one additional slot spaced from the other slots and extending generally longitudinally along the member generally from the vicinity of the base portion, a dielectric material held within and generally conforming to the shape of said additional slot, and means for feeding a second radiating signal to said dielectric material, the dimensions of said slot being selected to produce signal radiation over a second predetermined frequency band.

* * * * *